US011027562B2

(12) United States Patent
Herrmann et al.

(10) Patent No.: US 11,027,562 B2
(45) Date of Patent: Jun. 8, 2021

(54) POSITIVE PRESSURE PLENUM SYSTEM FOR TRANSPORT BELTS IN A PRINTING DEVICE

(71) Applicant: Xerox Corporation, Norwalk, CT (US)

(72) Inventors: Douglas K. Herrmann, Webster, NY (US); Chu-heng Liu, Penfield, NY (US); Seemit Praharaj, Webster, NY (US); Paul J. McConville, Webster, NY (US); Jason Matthew LeFevre, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 16/380,551

(22) Filed: Apr. 10, 2019

(65) Prior Publication Data

US 2020/0324558 A1 Oct. 15, 2020

(51) Int. Cl.
*B41J 11/00* (2006.01)

(52) U.S. Cl.
CPC ..... *B41J 11/0085* (2013.01); *B41J 11/007* (2013.01)

(58) Field of Classification Search
None
See application file for complete search history.

(56) References Cited

U.S. PATENT DOCUMENTS

| | | | | |
|---|---|---|---|---|
| 5,717,446 | A | 2/1998 | Teumer et al. | |
| 6,254,092 | B1 | 7/2001 | Yraceburu et al. | |
| 6,394,596 | B1 * | 5/2002 | Wotton | B41J 11/007 226/172 |
| 8,413,794 | B2 | 4/2013 | Herrmann | |
| 2010/0302331 | A1 * | 12/2010 | Bober | B41J 11/007 347/104 |
| 2014/0245950 | A1 * | 9/2014 | Seccombe | B41J 11/002 118/620 |
| 2014/0267523 | A1 * | 9/2014 | Herrmann | B41J 11/0085 347/104 |

* cited by examiner

*Primary Examiner* — Erica S Lin

(57) ABSTRACT

A printing module and a method for controlling the same are disclosed. For example, the printing module includes a plurality of printheads, a transport belt located below the plurality of printheads to transport print media below the plurality of printheads, wherein the transport belt comprises a plurality of vacuum openings, and a positive pressure plenum system, wherein the positive pressure plenum system provides a positive air flow to create an air interface between a top surface of the positive pressure plenum system and a bottom surface of the transport belt, wherein the positive pressure plenum system provides a negative air flow to create a vacuum through the plurality of vacuum openings of the transport belt to hold the print media against the transport belt.

12 Claims, 7 Drawing Sheets

POSITIVE PRESSURE PLENUM SYSTEM FOR TRANSPORT BELTS IN A PRINTING DEVICE

The present disclosure relates generally to printing devices and, more particularly, to a plenum system that provides positive pressure for transport belts in a printing device.

BACKGROUND

Printing devices can be used to print images on print media. The print media can be fed through the printing device along a transport path and imaging path to have the image printed. The transport path can use belts to transport the print media below print heads. In some designs, the transport belt may use a plenum that provides a vacuum to help keep the print media against the transport belt as the print media moves under the print heads. As a result, the print media may remain in place while being moved by the transport belt such that ink can be accurately dispensed onto the print media.

Current generation printers can transport print media at very high speeds and process hundreds and thousands of sheets of print media per print job. The high volume printing can cause the transport belts to continuously move against a plenum. As a result, the constant friction between the transport belt and the plenum can cause wear on the transport belt causing frequent replacement of the transport belt. Frequent replacement of the transport belt may lead to higher costs and lower production.

In addition, the friction between the transport belt and the plenum can cause the transport belt to move inefficiently. The friction may be caused by constant contact of the transport belt against the plenum or due to ink build up on the surface of the plenum. The high amount of friction may cause the motors driving the transport belt to work harder to move the transport belt due to the friction. Consuming more power may lead to higher energy costs and quicker wear of the motors driving the transport belt.

SUMMARY

According to aspects illustrated herein, there are provided a printing module and a method for controlling the same. One disclosed feature of the embodiments is a printing module comprising a plurality of printheads, a transport belt located below the plurality of printheads to transport print media below the plurality of printheads, wherein the transport belt comprises a plurality of vacuum openings, and a positive pressure plenum system, wherein the positive pressure plenum system provides a positive air flow to create an air interface between a top surface of the positive pressure plenum system and a bottom surface of the transport belt, wherein the positive pressure plenum system provides a negative air flow to create a vacuum through the plurality of vacuum openings of the transport belt to hold the print media against the transport belt.

Another disclosed feature of the embodiments is a method for controlling a printing module. In one embodiment, the method detects a print media entering the printing module to receive a print job, provides a vacuum, in response to the print media that is detected, via a positive pressure plenum that provides a negative air flow through a plurality of vacuum openings of a transport belt to hold the print media against the transport belt as the transport belt moves the print media below a plurality printheads, and provides a positive air flow, in response to the print media that is detected, through the positive pressure plenum to provide an air interface between a bottom surface of the transport belt and a top surface of the positive pressure plenum as the transport belt moves across the top surface of the positive pressure plenum.

BRIEF DESCRIPTION OF THE DRAWINGS

The teaching of the present disclosure can be readily understood by considering the following detailed description in conjunction with the accompanying drawings, in which.

To facilitate understanding, identical reference numerals have been used, where possible, to designate identical elements that are common to the figures.

DETAILED DESCRIPTION

The present disclosure is related to a registration system of a positive pressure plenum for transport belts in a printing device and a method for operating the same. As discussed above, current generation printers can transport print media at very high speeds and process hundreds and thousands of sheets of print media per print job. The high volume printing can cause the transport belts to continuously move against a plenum. As a result, the constant friction between the transport belt and the plenum can cause wear on the transport belt causing frequent replacement of the transport belt. Frequent replacement of the transport belt may lead to higher costs and lower production.

In addition, the friction between the transport belt and the plenum can cause the transport belt to move inefficiently. The friction may be caused by constant contact of the transport belt against the plenum or due to ink build up on the surface of the plenum. The high amount of friction may cause the motors driving the transport belt to work harder to move the transport belt due to the friction. Consuming more power may lead to higher energy costs and quicker wear of the motors driving the transport belt.

Embodiments of the present disclosure provide a positive pressure plenum that can provide positive pressure to reduce the friction between the transport belt and the positive pressure plenum. For example, the positive pressure may provide an air interface between the transport belt and the positive pressure plenum as the transport belt moves across the top of the positive pressure plenum.

In addition, the vacuum openings of the positive pressure plenum may be aligned with openings of the transport belt. The positive pressure openings of the positive pressure plenum may be positioned under portions of the transport belt without holes. As a result, a vacuum may still be applied to the print media to hold the print media against the transport belt.

The air from the positive pressure may move across the bottom surface of the transport belt and into the vacuum openings of the positive pressure plenum. As a result, the positive pressure plenum of the present disclosure may provide more efficient movement of the transport belt with less friction and less wear on the transport belt.

Figure 1:
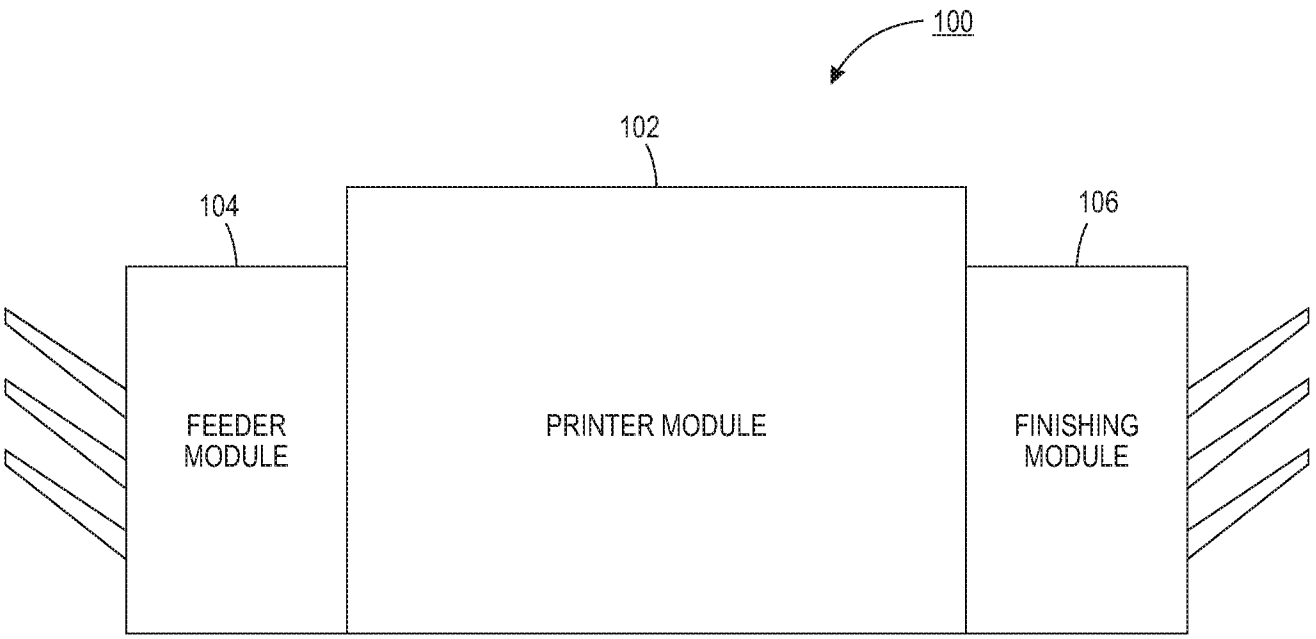
FIG. 1 illustrates a block diagram of an example printing device of the present disclosure.

FIG. 1 illustrates a block diagram of an example printing device 100 of the present disclosure. The printing device 100 may be any type of printing device such as a multi-function device (MFD), a copy machine, laser printer, an ink jet printer, and the like.

In one embodiment, the printing device 100 may include a feeder module 104, a printing module 102, and a finishing module 106. It should be noted that the printing device 100 has been simplified for ease of explanation. The printing device 100 may include additional components and modules that are not shown. For example, the printing device 100 may include a duplex paper path, a digital front end, a graphical user interface (GUI), and the like.

In one embodiment, the feeder module 104 may include feeder trays that feed print media through the printing device 100. The print media may be any type of print media such as paper, card stock, and the like, and may have any dimensions. The feeder module 104 may feed the print media to the printing module 102.

In one embodiment, the printing module 102 may print an image onto the print media. The image may be provided via a print job. The print job may be transmitted to the printing device 100 via a remote computing device or locally via a graphical user interface of the printing device 100. For example, the print job may be selected from a memory stick that can be inserted into an interface of the printing device 100.

In one embodiment, after the image is printed onto the print media, the print media may be transported to the finishing module 106. The finishing module 106 may perform finishing functions, such as stapling, collating, stacking, and the like.

Figure 2:
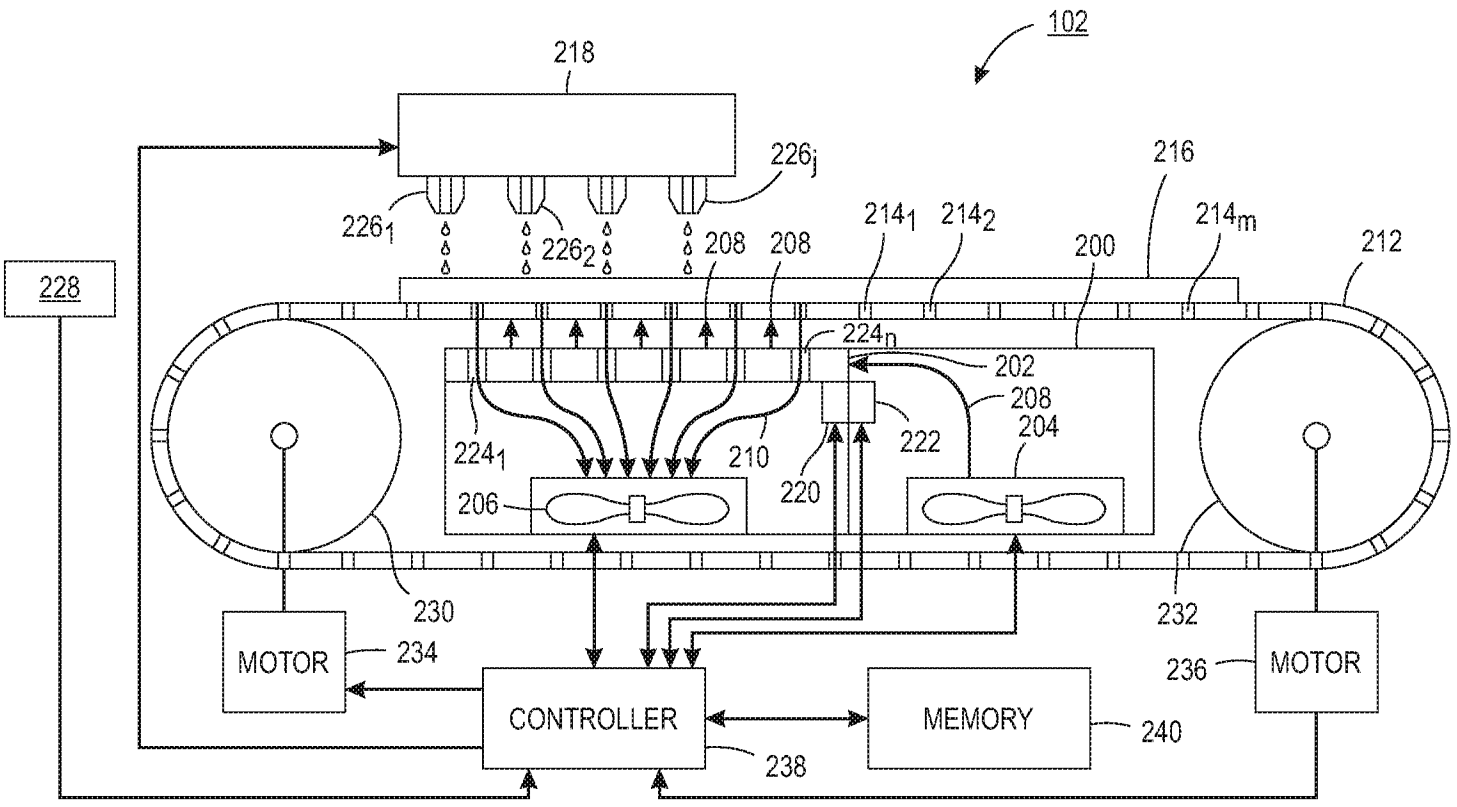
FIG. 2 illustrates a side view of a printing module that includes printheads, a transport belt, and a positive pressure plenum of the present disclosure.

FIG. 2 illustrates a more detailed block diagram of the printing module 102. FIG. 2 illustrates a cross-sectional side view of the printing module 102. In one embodiment, a print media 216 may be fed from the left and travel to the right through the printing module 102.

In one embodiment, the printing module 102 may include a printhead 218 that includes a plurality of print nozzles $\mathbf{226}_1$ to $\mathbf{226}_j$ (also referred to herein individually as a print nozzle 226 or collectively as print nozzles 226). In one embodiment, the number of print nozzles 226 may correspond to a color system dispensed by the printhead 218 or to a number of individual colored inks that can be dispensed by the printhead 218. Although a single printhead 218 is illustrated in FIG. 2, it should be noted that any number of printheads 218 can be deployed in the printing module 102.

In one embodiment, a transport belt 212 may be used to transport the print media 216 through the printing module 102 and below the printhead 218 to receive printing fluid in accordance with a print job. In one example, the transport belt 212 may be made from a rubber material, a polymer material, a flexible plastic material, and the like.

In one embodiment, the transport belt 212 may be driven by a pair of drive rollers 230 and 232. The drive rollers 230 and 232 may be rotated or powered by a respective motor 234 and 236. For example, the motor 234 may drive the drive roller 230 and the motor 236 may drive the drive roller 232. In another embodiment, a single drive roller and motor may be deployed with freely moving idler rollers that are not driven by a motor.

Figure 3:
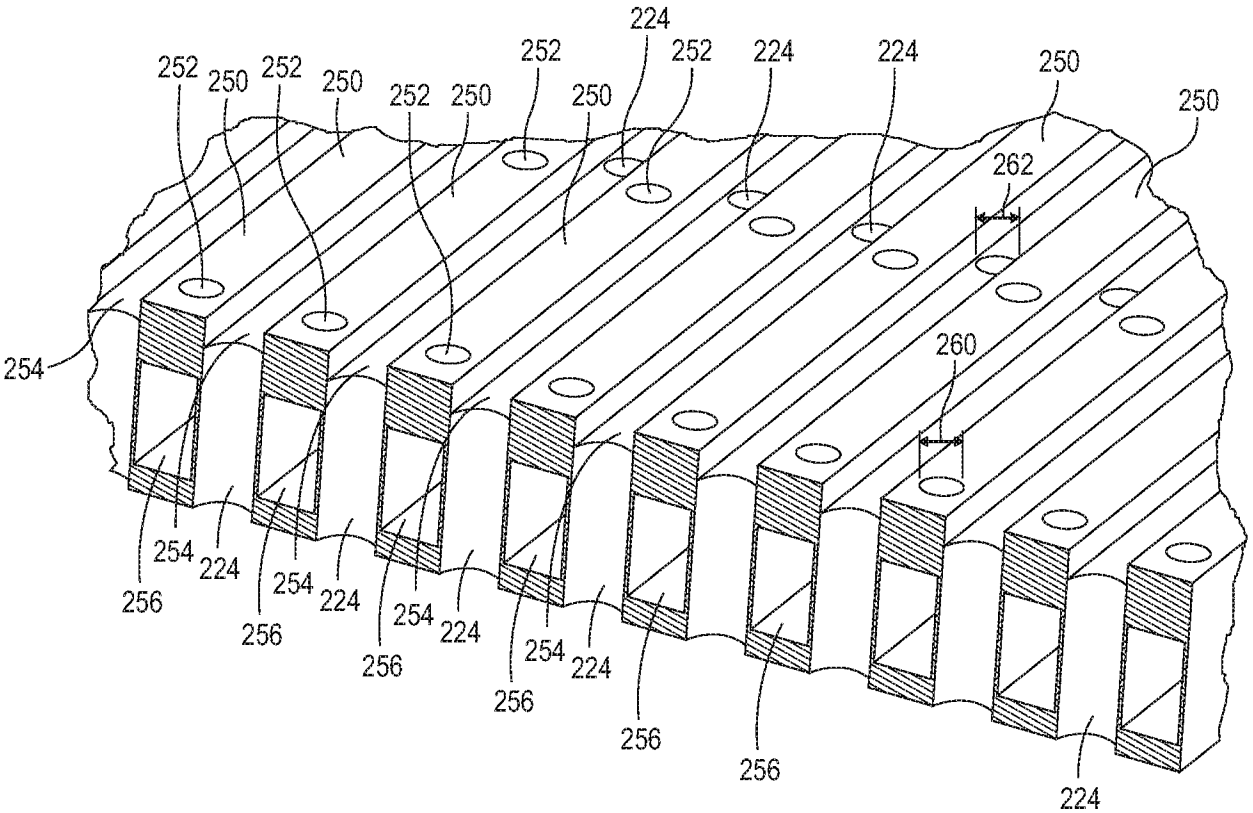
FIG. 3 illustrates an isometric cross-sectional view of the positive pressure plenum that shows tunnels associated with the positive pressure openings and the vacuum openings.
Figure 4:
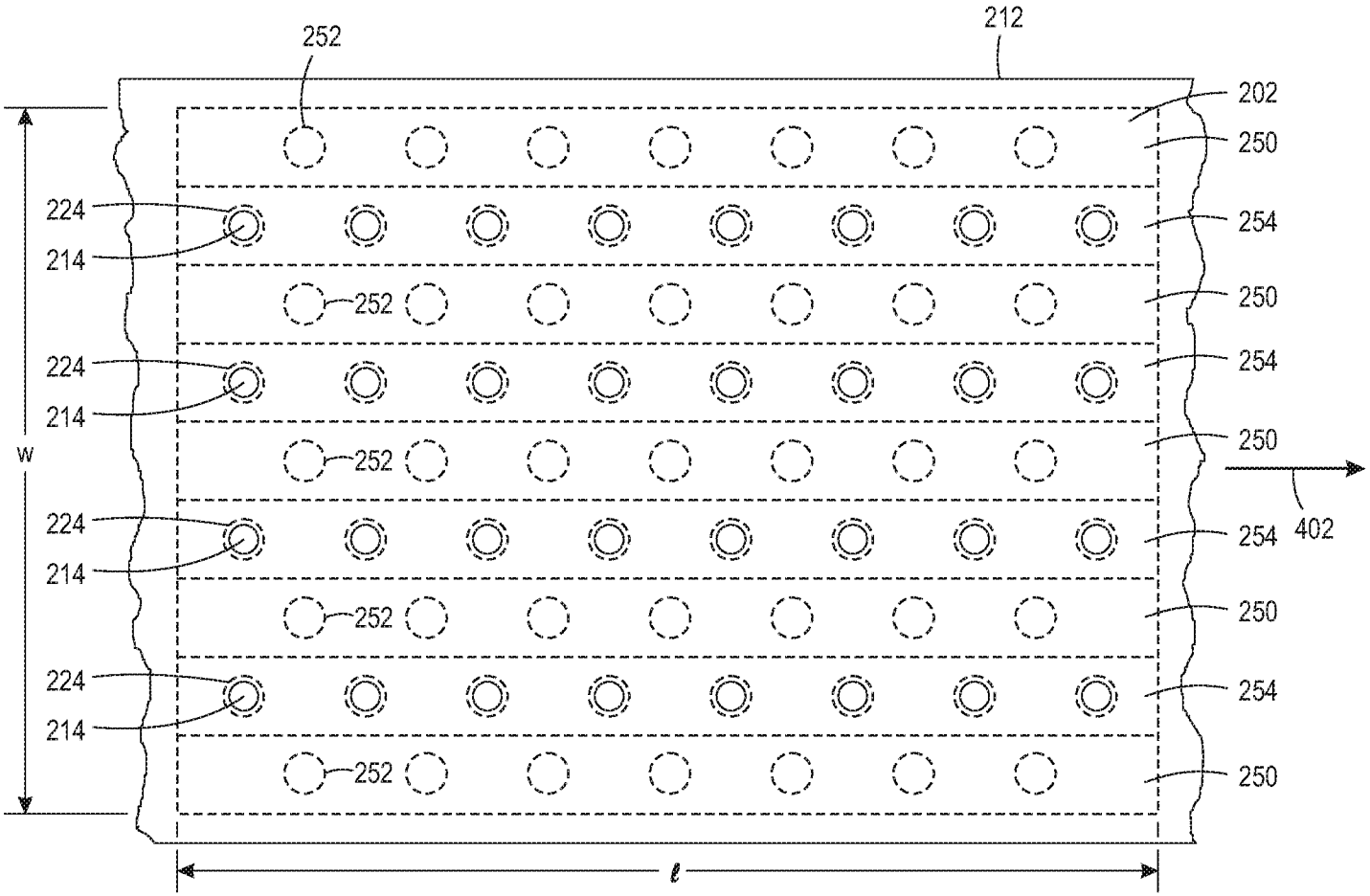
FIG. 4 illustrates a top view of the transport belt on the positive pressure plenum of the present disclosure.

In one embodiment, the printing module 102 of the present disclosure may also include a positive pressure plenum system 200 (also referred to as a positive pressure plenum). The positive pressure plenum system 200 may help provide positive air flow to a bottom surface of the transport belt 212 to create an air interface. The air interface may reduce the amount of friction and wear on the transport belt 212. For example, the air interface may prevent the bottom of the transport belt 212 from rubbing against a top surface of ridges of a plate 202. The ridges are illustrated in FIGS. 3 and 4, and discussed in further details below.

In one embodiment, the positive pressure plenum system 200 may include a positive air flow source 204. The positive air flow source 204 may be a fan, a blower, and the like. The positive air flow source 204 may provide air through the plate 202 and out of positive pressure openings (illustrated in FIGS. 3 and 4 and discussed in further details below). The positive air flow is shown by arrows 208 entering the plate 202 and exiting from the plate 202 towards the bottom of the transport belt 212.

In one embodiment, the positive air flow source 204 may be enclosed in a housing. The housing may ensure that the positive air flow generated by the positive air flow source 204 moves towards the plate 202 and out of the positive pressure openings of the plate, as described below in FIGS. 3 and 4. In some embodiments, mechanical structures such as piping, tubing, funnels, and the like, may be used to help move the positive air flow toward and through the plate 202.

In one embodiment, the positive pressure plenum system 200 may also include a plurality of vacuum openings $\mathbf{224}_1$ to $\mathbf{224}_n$ (hereinafter also referred to individually as a vacuum opening 224 or collectively as vacuum openings 224). A negative air flow source 206 may provide a negative air flow that sucks air out of the plate 202 towards the negative air flow source 206. The negative air flow is illustrated by arrows 210 in FIG. 2.

In one embodiment, the negative air flow source 206 may be also enclosed in a housing. The housing of the negative air flow source 206 may be separate from the housing of the positive air flow source 204. However, both the housing of the positive air flow source 204 and the housing of the negative air flow source 206 may be coupled to the plate 202.

In one embodiment, the housing of the negative air flow source 206 may be coupled to an exhaust to remove the negative air flow or vacuum generated by the negative air flow source 206. In one embodiment, the negative air flow generated by the negative air flow source 206 may be piped back into the housing of the positive air flow source 204. As a result, the air flow may be recycled or recirculated as part of a closed loop system.

In one embodiment, the negative air flow 210 may be pulled through a plurality of vacuum openings $\mathbf{214}_1$ to $\mathbf{214}_m$ (hereinafter also referred to individually as a vacuum opening 214 or collectively as vacuum openings 214) and the vacuum openings 224 of the plate 202. For example, the vacuum openings 214 of the transport belt 212 may be aligned with the vacuum openings 224 of the plate 202 such that as the transport belt 212 is moved the vacuum openings 214 may temporarily align with a vacuum opening 224.

The negative air flow 210 may help keep the print media 216 against the transport belt 212 as the transport belt 212 moves the print media 216 through the printing module 102.

For example, the negative air flow 210 may create a vacuum that "sucks" the print media 216 against a top surface of the transport belt 212. Thus, the print media 216 may be held in place by the vacuum to allow the printing fluid to be accurately dispensed onto desired locations on the print media 216 in accordance with a print job.

In one embodiment, "positive" air flow may be considered to be air flow that is being added to the plate 202. For example, the positive air flow source 204 may generate air flow that is inserted into the plate 202. In one embodiment, "negative" air flow may be considered to be air flow that is being removed from the plate 202.

In one embodiment, the printing module 102 may also include a controller 238 and a memory 240. The controller 238 may be communicatively coupled to the positive air flow source 204, the negative air flow source 206, the motor 234, the motor 236, and the memory 240. In one embodiment, the controller 238 may also be communicatively coupled to a negative air flow sensor 220, a positive air flow sensor 222, and a sensor 228.

In one embodiment, the controller 238 may control operation of the motor 234 and the motor 236 when the sensor 228 detects the print media 216 entering the printing module 102. In another embodiment, the sensor 228 may be located upstream of the transport belt 212 to detect when the print media 216 is about to arrive on the transport belt 212. The sensor 228 may be part of a registration system that is used to properly orient the print media 216 (e.g., adjusting a skew, lateral position, and the like) before the print media 216 is placed onto the transport belt 212. The sensor 228 may be any type of sensor that can detect the print media 212.

The controller 238 may begin to operate the motor 234 and the motor 236 to rotate the drive rollers 230 and 232, respectively. The drive rollers 230 and 232 may then begin to rotate the transport belt 212. In addition, the controller 238 may begin operation of the positive air flow source 204 and the negative air flow source 206.

In one embodiment, the controller 238 may operate the positive air flow source 204 and the negative air flow source 206 such that a desired amount of positive air flow and a desired amount of negative air flow is generated. The amount of positive air flow may be measured by the positive air flow sensor 222. The controller 238 may receive the amount of positive air flow measured by the positive air flow sensor 222 and adjust the amount (e.g., increase or decrease) of positive air flow generated by the positive air flow source 204. Similarly, the controller 238 may receive the amount of negative air flow measured by the negative air flow sensor 220 and adjust the amount (e.g., increase or decrease) of negative air flow generated by the negative air flow source 206.

In one embodiment, the desired amounts of air flow may be stored in the memory 240. For example, the controller 238 may compare the measured amount of positive air flow and the measured amount of negative air flow and compare the amounts to the desired amounts stored in the memory 240. Based on the comparison, the controller 238 may adjust the amount of air flow generated by the positive air flow source 204 and the negative air flow source 206.

In one embodiment, the desired amount of negative air flow may be greater than the desired amount of positive air flow. In one embodiment, the memory 240 may store a desired difference threshold that is a difference between the amount negative air flow and the amount of positive air flow. The values of the threshold may be a function of process parameters of a particular print job, operating efficiency of the transport belt 212 at a given time, and the like. For example, for larger print media 216 the difference may be lower as the weight of the print media 216 may require less negative air flow to hold the print media 216 against the transport belt 212. However, more positive air flow may be used to create the air interface due to the added weight of the larger print media 216. However, the amount of negative air flow would still be greater than the amount of positive air flow.

In another example, for smaller print media 216, the difference may be larger as the lighter weight of the print media 216 may require less negative air flow to hold the print media 216 against the transport belt 212. However, less positive air flow may be used to create the air interface due to the lower weight associated with the smaller print media 216. Again, the amount of negative air flow would be greater than the amount of positive air flow.

In one example, as the printing fluid falls through the openings of the transport belt 212 between sheets of the print media 216 onto a top surface of the plate 202, the transport belt 212 may experience more friction as the transport belt 212 moves. Thus, the amount of positive air flow may be increased by the controller 238 to create the air interface between the top surface of the plate 202 and a bottom surface of the transport belt 212. However, to ensure the negative air flow is greater than the positive air flow, the amount of negative air flow may also be adjusted accordingly.

FIG. 3 illustrates an isometric cross-sectional view of the plate 202. FIG. 3 provides a better illustration of the structural features of the plate 202 in the positive pressure plenum system 200 of the present disclosure. The plate 202 may be fabricated from a metal, alloy, plastic, glass, and the like.

In one embodiment, the plate 202 may include ridges 250. The plurality of ridges 250 may have a raised surface. The top surface of the ridges 250 may contact the bottom surface of the transport belt 212. The plurality of ridges may run in parallel and be spaced apart across a top surface of the plate 202. In one embodiment, each one of the plurality of ridges may have the same dimensions.

In one embodiment, each one of the plurality of ridges 250 may include a plurality of positive pressure openings 252. The positive pressure openings 252 may be spaced apart along the top surface of the plurality of ridges 250. In one embodiment, the minimum amount of positive air flow that is generated by the positive air flow source 204 may be enough positive air flow to allow the positive air flow to escape out of the positive pressure openings 252.

Any number of positive pressure openings 252 may be deployed in each one of the plurality of ridges 250. Each one of the plurality of ridges 250 may have the same number of positive pressure openings 252 or may have a different number of positive pressure openings 252.

As illustrated in FIG. 4, and discussed in further details below, the positive pressure openings 252 are located such that the positive pressure openings 252 do not align with the vacuum openings 214 of the transport belt 212. In other words, the positive pressure openings 252 are positioned to be continuously against a solid portion of the transport belt 212 as the transport belt 212 moves around the positive pressure plenum system 200.

In one embodiment, each one of the plurality of ridges 250 may have a hollow opening, a hollow ridge, or a tunnel 256. One end of the plurality of ridges 250 may be open to allow the positive air flow generated by the positive air flow source 204 to enter the tunnels 256. The opposite end of the plurality of ridges 250 may be closed to prevent the positive air flow from running straight through the plurality of ridges 250. In other words, the tunnels 256 may be formed across the entire distance of the ridges 250 up to the closed end. Thus, the positive air flow is forced out of the positive pressure openings 252 in a direction that is towards the bottom surface of the transport belt 212.

Said another way, the positive air flow may enter the plate 202 laterally through the tunnels 256 of each one of the plurality of ridges 250. However, the positive air flow may exit through the positive pressure openings 252 in a direction that is perpendicular to the lateral flow of the positive air flow that enters the tunnels 256.

In one embodiment, the plurality of ridges 250 may be spaced apart, as noted above. In one embodiment, a depressed region or trough 254 may be located between each one of the plurality of ridges 250. In other words, the plate 202 may include a plurality of troughs 254, wherein each one of the plurality of troughs 254 is located between a pair of the ridges 250. Said another way, the top surface of the plate 202 may comprise an alternating series of a ridge 250 and a trough 254. The plurality of troughs 254 may have the same dimensions; however, the dimensions of the plurality of troughs 254 may be different than the dimensions of the plurality of ridges 250.

In one embodiment, the plurality of troughs 254 may include a plurality of vacuum openings 224. Each one of the plurality of troughs 254 may have any number of vacuum openings 224. As can be seen in FIG. 3, the vacuum openings 224 may be cut through the entire thickness of the troughs 254. In other words, the vacuum openings 224 may be cut from a bottom surface of the plate 202 through the entire thickness of the plate 202 and to the top surface of the trough 254.

In addition, the vacuum openings 224 may be cut such that the vacuum openings 224 do not communicate with the tunnels 256 and the positive pressure openings 252. In other words, the vacuum openings 224 may be isolated from the tunnels 256 and the positive pressure openings 252. Said yet another way, the positive air flow that enters the tunnel 256 must exit through the positive pressure openings 252 and cannot enter the vacuum openings 224 without first exiting through the positive pressure openings 252.

In one embodiment, a diameter 262 of the vacuum openings 224 may be larger than a diameter 260 of the positive pressure openings 252. The larger size of the diameter 262 of the vacuum openings 224 may help to ensure that the amount of negative air flow through the vacuum openings 224 is greater than the positive air flow through the positive pressure openings 252, as noted above. In one example, the diameter 260 of the positive pressure openings 252 may be approximately 2 millimeters (mm) and the diameter 262 of the vacuum openings 224 may be approximately 3 mm.

In one embodiment, the 2 mm diameter and the 3 mm diameter is sufficient to generate a desired amount of positive air flow to create an air interface between the plurality of ridges 250 and a bottom surface of the transport belt 212. The 2 mm diameter and the 3 mm diameter are also sufficient to generate a desired amount of negative air flow to create a vacuum to hold the print media 216 against the top surface of the transport belt 212. However, it should be noted that other dimensions for the diameter 260 and 262 may also be deployed to achieve the desired amount of positive air flow and the desired amount of negative air flow.

FIG. 4 illustrates a top view of an example of the transport belt 212 and the plate 202. FIG. 4 illustrates an example where the process direction is shown by an arrow 402. For example, the print media 216 may enter from the left and be transported to the right out of the printing module 102.

The plate 202 is illustrated in phantom lines or dashed lines below the transport belt 212. In one embodiment, the plate 202 may have a width "w" and a length "l". The plurality of ridges 250 and the plurality of troughs 254 may run across a length of the plate 202, as shown in dashed lines being hidden by the transport belt 212. The plurality of ridges 250 and the plurality of troughs 254 may be alternated across a width of the plate 202.

As noted above, the transport belt 212 may be positioned such that the vacuum openings 214 of the transport belt 212 are aligned with the vacuum openings 224 (shown in dashed lines below the transport belt 212) in the plurality of troughs 254 of the plate 202. In one example, the line of vacuum openings 214 of the transport belt 212 may travel along the length of the respective trough 254 and respective vacuum openings 224. As a result, the vacuum may be applied continuously to the print media 216 on the transport belt 212. Although FIG. 4 illustrates a diameter of the vacuum openings 224 being larger than the vacuum openings 214, it should be noted that in one embodiment the vacuum openings 214 and the vacuum openings 224 may have approximately the same diameter.

In one embodiment, "aligned" may mean that the line of vacuum openings 214 lies on the same line of vacuum openings 224. As a result, as the transport belt 212 is moved from left to right, the vacuum openings 214 are positioned directly over a respective trough 254 and respective vacuum openings 224. As a result, the negative air flow may suck the print media 216 against the top surface of the transport belt 212 as the negative air flow is pulled through vacuum openings 214 and 224.

Also as noted above, the positive pressure openings 252 (shown in dashed lines below the transport belt 212) may be positioned such that they are always below a solid portion of the transport belt 212. In other words, the vacuum openings 214 are never aligned or positioned over the positive pressure openings 252 as the transport belt 212 is moved in the process direction 402.

The location of the positive pressure openings 252 relative to the solid portions of the transport belt 212 (e.g., areas without the vacuum openings 214) may prevent the positive air flow from counteracting the vacuum applied by the negative air flow, as described above. In addition, the positive air flow may push against the bottom surface of the transport belt 212 to create the air interface, as described above. The air interface may allow the transport belt to "hover" over the top surface of the plate 202 or the plurality of ridges 250 as the transport belt 212 moves in the process direction 402. Thus, the air interface may reduce the overall friction and wear on the transport belt 212 as the transport belt 212 is moved.

Figure 5:
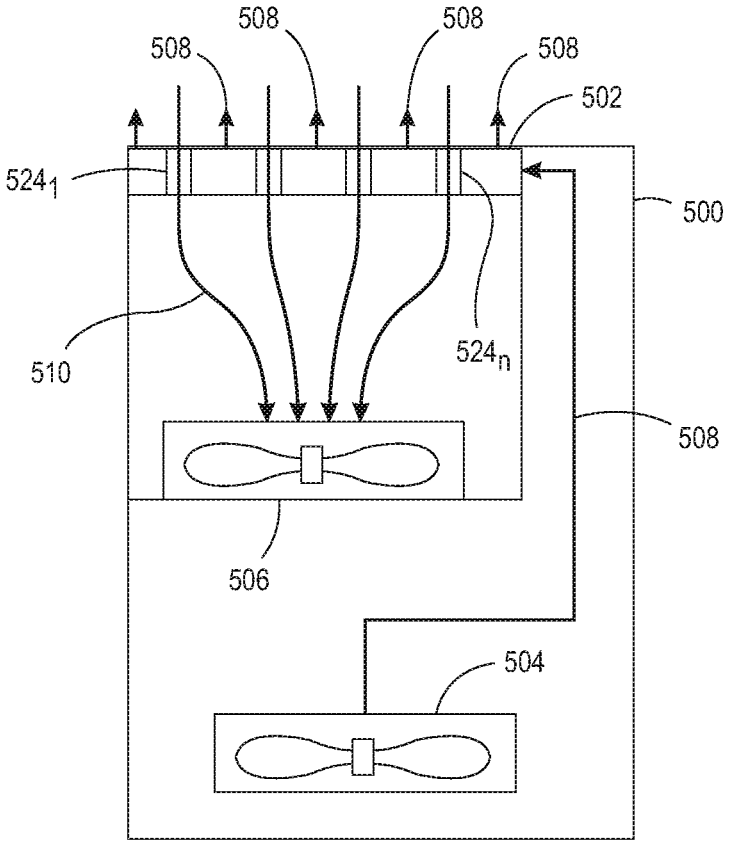
FIG. 5 illustrates another embodiment of the positive pressure plenum of the present disclosure.

FIG. 5 illustrates another example of a positive pressure plenum system 500. For example, although FIG. 2 illustrates the positive pressure plenum system 200 with the positive air flow source 204 and the negative air flow source 206 in a side-by-side configuration, other configurations are also possible. For example, FIG. 5 illustrates a configuration where a positive air flow source 504 is located below a negative air flow source 506. The top and bottom configuration illustrated in FIG. 5 may be deployed where less room is available across a length of the printing module 102.

The positive air flow source 504 may provide a positive air flow (as shown by an arrow 508) up and laterally through the plate 502. The plate 502 may be similar to the plate 202 and be comprised of a plurality of ridges that contain tunnels and positive pressure openings along a top surface of the plurality of ridges. The positive air flow may exit out of the positive pressure openings towards a bottom surface of a transport belt (e.g., the transport belt 212). In some embodiments, a tubing, funnels, piping, and other mechanical features (not shown) may be used to channel the positive air flow generated by the positive air source 504 to the plate 502.

In one embodiment, the plate 502 may also include a plurality of troughs similar to the plate 202 that include a plurality of vacuum openings $\mathbf{524}_1$ to $\mathbf{524}_n$ (also referred to herein individually as a vacuum opening 524 or collectively as vacuum openings 524) along the troughs. The troughs and the ridges may be arranged as described above with respect to the plate 202.

In one embodiment, the negative air flow source 506 may create a negative air flow or suck air down towards the negative air flow source 506, as shown by arrows 510. The negative air flow may be pulled through the vacuum openings 524 in the plate 502 to create a vacuum. The vacuum may hold the print media 216 against a top surface of the transport belt 212, as described above.

Similar to the positive pressure plenum system 200, the positive pressure plenum system 500 may also be controlled by the controller 238 to generate a desired amount of positive air flow and a desired amount of negative air flow. It should be noted that FIGS. 2 and 5 illustrate examples of possible configurations of the positive air flow source 504 the negative air flow source 506 and that other configurations are possible and within the scope of the present disclosure.

Figure 6:
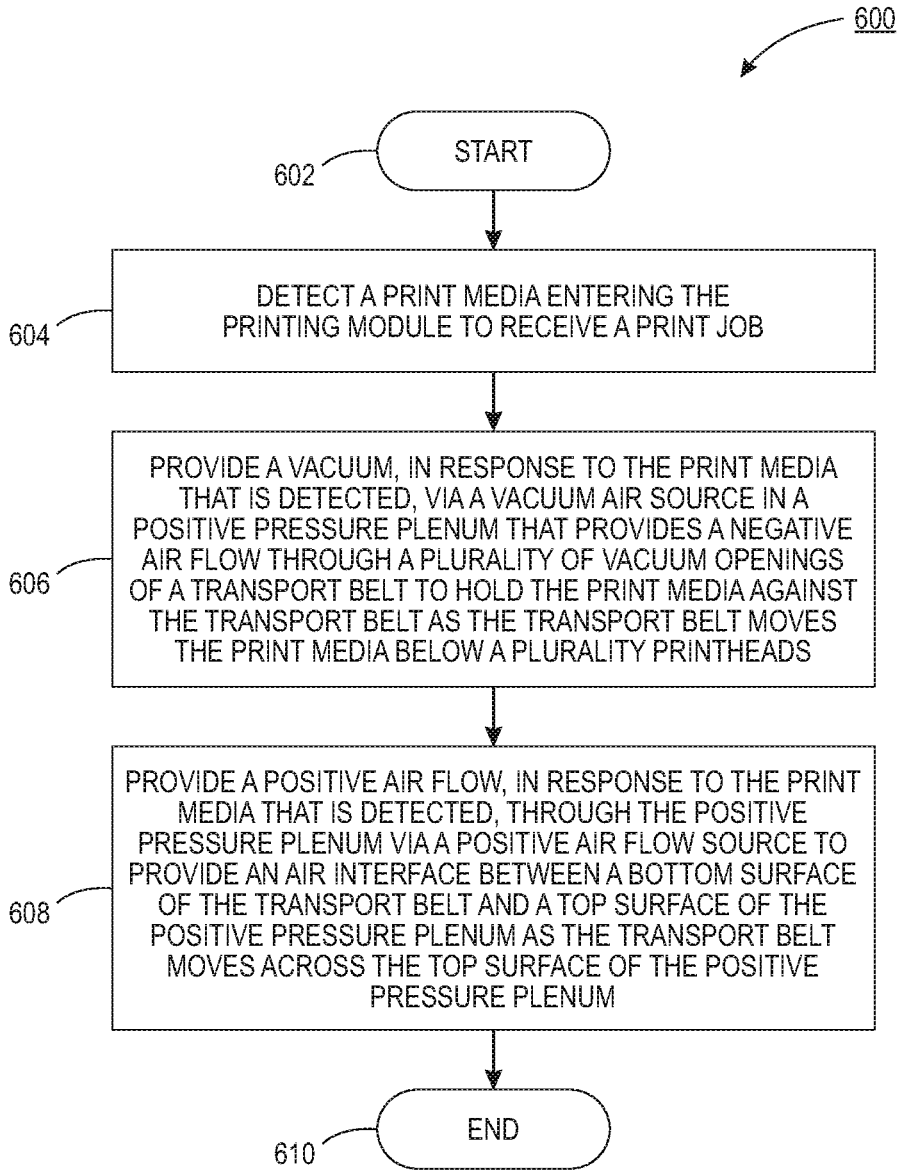
FIG. 6 illustrates a flowchart of an example method for operating a printing module of the present disclosure.
Figure 7:
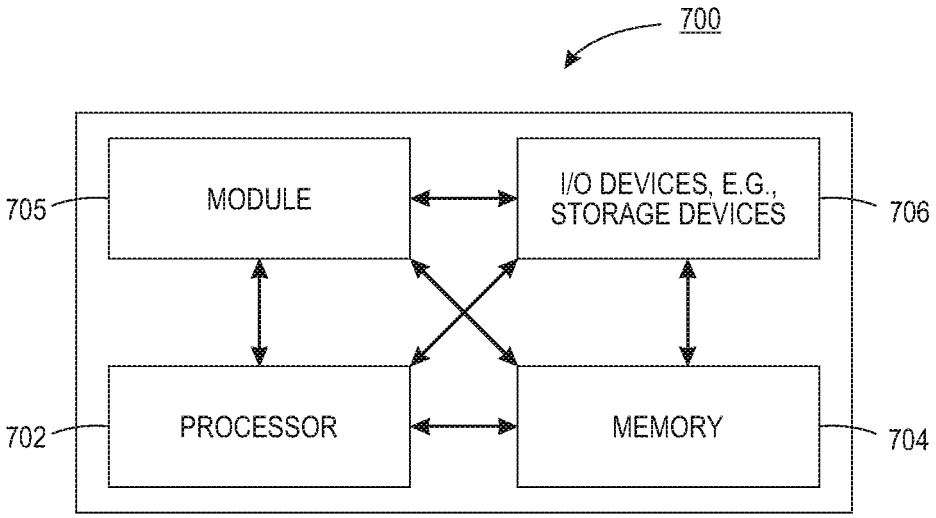
FIG. 7 illustrates a high-level block diagram of an example computer suitable for use in performing the functions described herein.

FIG. 6 illustrates a flowchart of an example method 600 for controlling a position of a print media in a registration system. In one embodiment, one or more steps or operations of the method 600 may be performed by the printing module 102 of the printing device 100, or a computer/processor that controls operation of the printing module 102 as illustrated in FIG. 7 and discussed below.

At block 602, the method 600 begins. At block 604, the method 600 detects a print media entering the printing module to receive a print job. For example, a sensor or a registration system may detect a lead edge of the print media entering the printing module. In response to detecting the print media, the transport belt may be activated and begin moving. The transport belt may receive the print media and begin transporting the print media through the printing module and below one or more printheads to receive printing fluid in accordance with a print job.

At block 606, the method 600 provides a vacuum, in response to the print media that is detected, via a vacuum air source in a positive pressure plenum that provides a negative air flow through a plurality of vacuum openings of a transport belt to hold the print media against the transport belt as the transport belt moves the print media below a plurality printheads. In one embodiment, the negative air flow may be sucked through a plurality of vacuum openings of the positive pressure plenum that are located in a plurality of depressed spaces or troughs located between a plurality of hollow ridges. The depressed spaces or troughs and the plurality of hollow ridges may be arranged as part of a plate, as described above and illustrated in FIGS. 3 and 4.

In one embodiment, the plurality of vacuum openings of the positive pressure plenum may be aligned with the plurality of vacuum openings of the transport belt as illustrated in FIG. 4. As a result, as the transport belt moves, the vacuum holes in the transport belt may travel over the depressed spaces or troughs and the respective vacuum holes in the positive pressure plenum. The negative air flow may then be pulled through the vacuum holes to hold the print media against the transport belt.

At block 608, the method 600 provides a positive air flow, in response to the print media that is detected, through the positive pressure plenum via a positive air flow source to provide an air interface between a bottom surface of the transport belt and a top surface of the positive pressure plenum as the transport belt moves across the top surface of the positive pressure plenum. In one embodiment, the air interface created by the positive air flow may help reduce friction and wear on the transport belt while the transport belt is moving.

In one embodiment, the amount of positive air flow that is generated may be less than the amount of negative air flow that is generated to ensure that there is sufficient vacuum to hold the print media against the transport belt. In one embodiment, the amount of positive air flow that is generated may be sufficient to allow the positive air flow to escape from the positive pressure plenum and out between the positive pressure plenum and a bottom surface of the transport belt.

In one embodiment, a controller may control and adjust the amount of negative air flow that is generated and the amount of positive air flow that is generated. For example, the method 600 may measure the amount of negative air flow via a vacuum (or negative air flow) sensor and measure the amount of positive air flow via a positive air flow sensor. The controller may then compare the amount of negative air flow that is measured and the amount of positive air flow that is measured to desired amounts or to a desired difference threshold. Based on the comparison, the controller may adjust the amount of negative air flow and/or the amount of positive air flow that is generated.

In one embodiment, the desired difference threshold may be based on printing parameters such as a type of print media that is being used (e.g., the size and the weight of the print media), a speed of the transport belt (e.g., the speed may change as ink is spilled onto a top surface of the ridges or plate of the positive pressure plenum), and the like. The difference threshold may be a difference between the amount of negative air flow sufficient to hold the print media and counteract the positive air flow and the amount of positive air flow sufficient to create the air interface between the top surface of the plate of the positive pressure plenum and a bottom surface of the transport belt. For example, the amount of positive air flow may be an amount sufficient to allow the positive air flow to escape between a bottom surface of the transport belt and the positive pressure openings of the positive pressure plenum.

The method 600 may be continuously repeated for each print media that is printed through the printing module 102. At block 610, the method 600 ends.

It should be noted that the blocks in FIG. 6 that recite a determining operation or involve a decision do not necessarily require that both branches of the determining operation be practiced. In other words, one of the branches of the determining operation can be deemed as an optional step. In addition, one or more steps, blocks, functions or operations of the above described method 600 may comprise optional steps, or can be combined, separated, and/or performed in a different order from that described above, without departing from the example embodiments of the present disclosure.

FIG. 7 depicts a high-level block diagram of a computer that is dedicated to perform the functions described herein. As depicted in FIG. 7, the computer 700 comprises one or more hardware processor elements 702 (e.g., a central processing unit (CPU), a microprocessor, or a multi-core processor), a memory 704, e.g., random access memory (RAM) and/or read only memory (ROM), a module 705 for operating a printing module, and various input/output devices 706 (e.g., storage devices, including but not limited to, a tape drive, a floppy drive, a hard disk drive or a compact disk drive, a receiver, a transmitter, a speaker, a display, a speech synthesizer, an output port, an input port and a user input device (such as a keyboard, a keypad, a mouse, a microphone and the like)). Although only one processor element is shown, it should be noted that the computer may employ a plurality of processor elements.

It should be noted that the present disclosure can be implemented in software and/or in a combination of software and hardware deployed on a hardware device, a computer or any other hardware equivalents (e.g., the printing device 100). For example, computer readable instructions pertaining to the method(s) discussed above can be used to configure a hardware processor to perform the steps, functions and/or operations of the above disclosed methods. In one embodiment, instructions and data for the present module or process 705 for operating a printing module (e.g., a software program comprising computer-executable instructions) can be loaded into memory 704 and executed by hardware processor element 702 to implement the steps, functions or operations as discussed above in connection with the example method 600. Furthermore, when a hardware processor executes instructions to perform "operations," this could include the hardware processor performing the operations directly and/or facilitating, directing, or cooperating with another hardware device or component (e.g., a co-processor and the like) to perform the operations.

The processor executing the computer readable or software instructions relating to the above described method(s) can be perceived as a programmed processor or a specialized processor. As such, the present module 705 for operating a printing module (including associated data structures) of the present disclosure can be stored on a tangible or physical (broadly non-transitory) computer-readable storage device or medium, e.g., volatile memory, non-volatile memory, ROM memory, RAM memory, magnetic or optical drive, device or diskette and the like. More specifically, the computer-readable storage device may comprise any physical devices that provide the ability to store information such as data and/or instructions to be accessed by a processor or a computing device such as a computer or an application server.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. A printing module, comprising:

a plurality of printheads;

a transport belt located below the plurality of printheads to transport print media below the plurality of printheads, wherein the transport belt comprises a plurality of vacuum openings;

a positive pressure plenum system, wherein the positive pressure plenum system provides a positive air flow to create an air interface between a top surface of the positive pressure plenum system and a bottom surface of the transport belt, wherein the positive pressure plenum system provides a negative air flow to create a vacuum through the plurality of vacuum openings of the transport belt to hold the print media against the transport belt;

a positive air flow sensor;

a vacuum air flow sensor; and a controller communicatively coupled to a positive air flow source and a negative air flow source to control an amount of positive air flow generated by the positive air flow source based on a positive air flow measurement by the positive air flow sensor and to control an amount of vacuum air flow generated by the negative air flow source based on a vacuum air flow measurement by the vacuum air flow sensor.

2. The printing module of claim 1, wherein the positive pressure plenum system comprises a plurality of hollow ridges, wherein each one of the plurality of hollow ridges comprises a plurality of positive pressure openings.

3. The printing module of claim 2, further comprising:

a positive air flow source to blow air through the plurality of hollow ridges and out of the plurality of positive pressure openings towards the bottom surface of the transport belt.

4. The printing module of claim 2, wherein the plurality of pressure openings are aligned with solid portions of the transport belt.

5. The printing module of claim 2, wherein the plurality of hollow ridges are arranged in parallel rows that contain a plurality of depressed spaces between the plurality of hollow ridges.

6. The printing module of claim 5, wherein the plurality of depressed spaces comprise a plurality of vacuum openings.

7. The printing module of claim 6, wherein a diameter of the plurality of vacuum openings of the plurality of depressed spaces is larger than a diameter of the plurality of positive pressure openings.

8. The printing module of claim 7, wherein the diameter of the plurality of vacuum openings of the plurality of depressed spaces is approximately 3 millimeters.

9. The printing module of claim 7, wherein the diameter of the plurality of positive pressure openings is approximately 2 millimeters.

10. The printing module of claim 5, further comprising:

a negative air flow source to create the vacuum and suck air in through the plurality of vacuum openings of the plurality of depressed spaces and the plurality of vacuum openings of the transport belt.

11. The printing module of claim 1, wherein the controller is to control the amount of vacuum air flow generated by the negative air flow source to be greater than the amount of positive air flow generated by the positive air flow source.

12. A printing module, comprising:

a plurality of printheads;

a transport belt located below the plurality of printheads to transport print media below the plurality of printheads, wherein the transport belt comprises a plurality of vacuum openings; and a positive pressure plenum system, wherein the positive pressure plenum system comprises:

a plate comprising a plurality of ridges and a plurality of troughs, wherein the plurality of ridges run across a width of the plate and are spaced apart in parallel by the plurality of troughs, wherein the plurality of ridges comprise a hollow tunnel inside of the plurality of ridges and a plurality of positive pressure openings on a top surface of the plurality of ridges, wherein the plurality of troughs comprise a plurality of vacuum openings that run through a thickness of the plate, wherein the plurality of vacuum openings do not communicate with the hollow tunnel inside of the plurality of ridges or the plurality of positive pressure openings, wherein the plurality of vacuum openings of the plurality of troughs are located to align with the plurality of vacuum openings of the transport belt;

a positive air flow source to provide a positive air flow through the hollow tunnel inside of the plurality of ridges, wherein the positive air flow is forced out through the plurality of positive pressure openings against a bottom surface of the transport belt; and a negative air flow source to provide a vacuum to create a negative air flow through the plurality of vacuum openings of the plurality of troughs and the plurality of vacuum openings of the transport belt to hold the print media against the transport belt as the transport belt travels across the positive pressure plenum system and below the plurality of printheads.

* * * * *